US007755009B2

(12) United States Patent
Lasko

(10) Patent No.: US 7,755,009 B2
(45) Date of Patent: Jul. 13, 2010

(54) COMPOUNDING THERMOPLASTIC MATERIALS IN-SITU

(76) Inventor: Bernard Lasko, 1029 Woodburn Rd., Spartanburg, SC (US) 29302

( * ) Notice: Subject to any disclaimer, the term of this patent is extended or adjusted under 35 U.S.C. 154(b) by 96 days.

(21) Appl. No.: 12/029,111

(22) Filed: Feb. 11, 2008

(65) Prior Publication Data

US 2008/0191391 A1 Aug. 14, 2008

Related U.S. Application Data

(60) Provisional application No. 60/889,491, filed on Feb. 12, 2007.

(51) Int. Cl.
*H05B 6/10* (2006.01)

(52) U.S. Cl. ..... 219/634; 219/675; 264/431; 366/146; 366/316

(58) Field of Classification Search ..... 219/634, 219/675; 241/23, 91; 264/431, 433; 366/144, 366/146, 147, 316
See application file for complete search history.

(56) References Cited

U.S. PATENT DOCUMENTS 3,238,024 A * 3/1966 Rodis et al. ..... 423/322
3,427,421 A * 2/1969 Clune et al. ..... 219/634
3,428,437 A * 2/1969 Anderson ..... 23/296
3,551,115 A * 12/1970 Jamieson et al. ..... 117/217
3,633,537 A * 1/1972 Howe ..... 118/725
3,636,293 A * 1/1972 Schneider et al. ..... 219/634
3,702,368 A * 11/1972 Hukin ..... 373/156
3,844,724 A * 10/1974 Sloan ..... 422/250.1
3,933,572 A * 1/1976 O'Connor et al. ..... 117/48
4,039,794 A * 8/1977 Kasper ..... 219/618
4,062,318 A * 12/1977 Ban et al. ..... 118/725
4,174,462 A * 11/1979 Pearce ..... 373/150
4,181,846 A * 1/1980 Cunningham ..... 219/619
4,275,282 A * 6/1981 Miller ..... 219/634
4,339,645 A * 7/1982 Miller ..... 219/634
4,678,881 A * 7/1987 Griffith ..... 219/631
4,978,825 A * 12/1990 Schmidt et al. ..... 219/633
5,374,120 A 12/1994 Possanza
5,406,058 A * 4/1995 Lipp ..... 219/774
5,455,402 A * 10/1995 Griffith ..... 219/630
5,660,669 A * 8/1997 Mittleider ..... 156/273.7
5,786,576 A * 7/1998 Lunden ..... 219/672
5,814,790 A 9/1998 Bondeson
5,919,387 A * 7/1999 Buckley et al. ..... 219/633
5,958,273 A 9/1999 Koch
6,043,469 A * 3/2000 Fink et al. ..... 219/634
6,147,336 A * 11/2000 Ushijima et al. ..... 219/601
6,230,936 B1 * 5/2001 Lasko ..... 222/146.5
6,297,483 B2 * 10/2001 Sadahira et al. ..... 219/629
6,348,679 B1 * 2/2002 Ryan et al. ..... 219/634
6,861,464 B2 3/2005 Eadara
7,070,743 B2 7/2006 Blackwell
2006/0191912 A1 * 8/2006 Roth ..... 219/675
2008/0223851 A1 * 9/2008 Biris et al. ..... 219/634
2009/0261090 A1 * 10/2009 Delperier et al. ..... 219/634

* cited by examiner

*Primary Examiner*—David L Sorkin
*Assistant Examiner*—Andrew Janca

(57) ABSTRACT

Multiple solid materials are introduced to a mixing vessel in defined proportion. They are melted by an electromagnetic induction heated susceptor and mixed simultaneously by the shearing action at the melt face of a second rotating susceptor. Material compounding takes place at the application site. Varying the physical structure of the susceptor or multiple susceptors processes materials of differing initial melt viscosity and particle size. Non-melting particulate material can be included in the mix. Reactive components can be combined at the application site.

8 Claims, 4 Drawing Sheets

COMPOUNDING THERMOPLASTIC MATERIALS IN-SITU

CROSS-REFERENCE TO RELATED APPLICATIONS

This application claims the benefits of provisional application Ser. No. 60/889,491 filed Feb. 12, 2007, in the United States Patent & Trademark office.

FIELD OF THE INVENTION

A method and apparatus is presented for melting and mixing materials at their point of application. The invention utilizes induction heated susceptors to liquefy and mix thermoplastic polymer materials and modifiers at their point of application.

BACKGROUND OF THE INVENTION

Many solid and semisolid materials are formulated for subsequent melting and dispensing after a period of storage that requires special packaging and handling. This may include provisions for excluding exposure to the atmosphere, particulate blocking, and extended heat degradation. Additional chemical additives and containerization are required to avoid these elements in the supply of materials for subsequent melting at the application site. Expensive bulk melting equipment employing a controlled atmosphere is required for some materials. Other materials form a char (solids in the melt that have to be filtered) that clogs the dispensing apparatus after extensive heat exposure.

Bulk hot melt materials are commonly palletized to accommodate shipping, handling, and storage for a variety of customer quantity requirements. Some semisolid materials cannot be palletized. Some formulations of palletized materials stick together and therefore preclude common vacuum handling at the melting and dispensing site.

The purpose of this invention is to address the cost in distribution, handling, and remelting that normally takes place in the application of hot melt materials. A significant energy reduction can be achieved in efficient melting only once in the compounding and dispensing cycle. Many hot melt adhesive formulations consist of a majority percentage of base material and minor amounts of additives specific to the application. Some producers of specialty materials could benefit from providing only the key application specific additives.

SUMMARY OF THE INVENTION

The invention relates to the combining, melting, and mixing of thermoplastic materials only in quantity as continuously required at the application site. This minor quantity in fast process can avoid additives, time at temperature and atmosphere degradation, and application process start-up delays.

In one embodiment of this invention the susceptor is ferrous metal foam specifically chosen to impart heat to the melting solid with a maximum surface area. Energy is imparted to the lattice of the open cell metal foam via a magnetic field. The frequency of this magnetic field is chosen to deliver a maximum power density consistent with the conductive heat transfer characteristics of the solid to liquid as it transits from one face of the susceptor to the other. Materials gravity flow upon obtaining a portion of the energy required to achieve an application temperature. The energy required to reduce the viscosity to gravity flow is obtained in the primary susceptor and the additional energy required to reach the application temperature is imparted as the material transits a secondary rotating susceptor.

The inductor coil is included within the mixing vessel for maximum efficiency, coincident cooling to the melt temperature, and safety. Maximum energy efficiency is obtained as all applied high frequency power is represented in the melted material. It is positioned in an annulus between a rotating susceptor and a stationary susceptor that thoroughly mixes the materials in their liquid state.

Additional control elements are included in the apparatus to vary the duration of the mix by susceptor rotation speed, thickness and strut size; gravity flow rate for materials of differing particle size and initial flow viscosity by the inclusion of a specific zone flow moderator; and varying the ratio of total heat input between susceptors by adjusting the space between the inductor coil and susceptors. Additional embodiments of this invention utilize different susceptor and reservoir shapes to advantage various material combinations and applications.

The apparatus can be modified to melt precompounded thermoplastic materials by removing the partitions and stopping the rotation of the secondary susceptor. The melted and mixed materials can exit directly to a bath, roll applicator, extruder, or pressurizing pump for nozzle application.

DETAILED DESCRIPTION OF THE INVENTION

Figure 1:
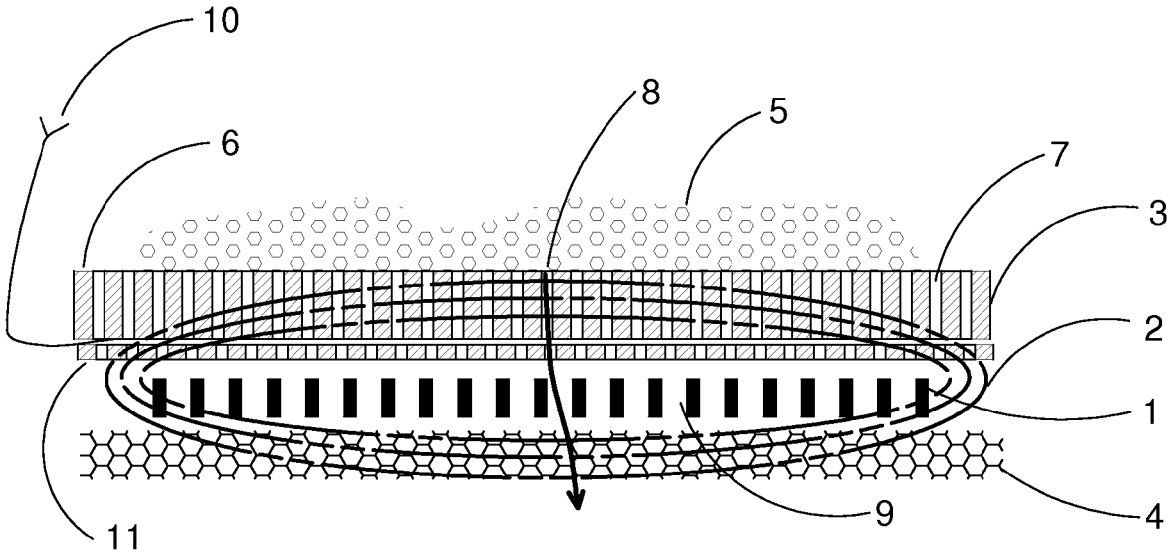
FIG. 1 is a cross section of a susceptor melt face

All apparatus described in this invention include items as shown in partial cross section FIG. 1. These items are placed in the order shown in close proximity to and substantially parallel to the energy-inducing coil 1. The magnetic field 2 of the inductor coil 1 intercepts the primarily susceptor 3 and secondarily rotating susceptor 4 to transform the electrical energy to heat in the form of resistive losses. Thermoplastic solid materials 5 in a particulate form are placed in contact with the heat susceptor 3. Solid materials 5 in contact with the primary surface 6 of the susceptor 3 will rise in temperature by heat conduction. As the melting thermoplastic materials 5 viscosity reduces, with added thermal conduction from the passages 7 of the susceptor 3, it flows in the direction of arrow 8. The efficient transfer of uniform energy to the susceptor 3 will enable the melting material to migrate through a defined plurality of passages 7 in susceptor 3 to its opposite face by gravity, vacuum, or centrifugal assist. Susceptors chosen for induction heating in this application will be electrically conductive, have a maximum surface area to volume ratio, be structurally ridged, and thin in cross section. These properties will maximize the conductive heat transfer to the material and minimize the latent heat in the system when shut off. The cross section and length of the passages 7 will be large enough to minimize the restriction of the flow of viscous materials.

The heat-inducing coil 1 will be preferably a solid copper wire. It will be placed as close to the susceptor 3 downstream surface as possible to maximize electrical efficiency and additionally be cooled to the melt temperature by the migrating melted material represented by arrow 8. This concept is described in Lasko patent No. 5584419. The relationship of the frequency of the magnetic field, its density, and profile to the physical, metallurgical, and electrical characteristics of a susceptor are well known in the induction heating industry. The individual turns of inductor coil 1 are spaced to induce the energy evenly into susceptors 3 & 4, and retain adequate inter-turn space 9 to avoid impeding the flow of liquid material.

A thermocouple 10 is placed on the downstream face of susceptor 3 to match the induced energy input of inductor coil 1 to the flow rate. Typical residency time for material transiting susceptor 3 is approximately two seconds. Where the gravity flow rate for less viscous material exceeds the susceptor surface area required for the target application temperature, a non-metallic flow moderator 11 is added to restrict the flow. This item is preferably a thin section of perforated high temperature material such as Teflon or PEEK that will not interfere with the distribution of the energy inducing magnetic field 2.

Rotating susceptor 4 is preferably constructed of metal foam such as Porvair FECRALY containing ten pores inch. This structure and the designed thickness are chosen to provide maximum mixing by shear as the material migrates vertically and laterally through the lattice of heated struts. The rotation speed is controlled and the shape of the cross section designed to afford all transiting material the same mix residency time. The proximity of the rotating susceptor 4 to the inductor coil 1 is chosen to proportion the added amount of heat imparted to the liquid material.

The frequency of the power applied to inductor coil 1 is chosen to efficiently heat the form of the susceptors 3 & 4 and is generally between 30 KHz and 100 KHz. Power density applied to primary susceptor surface 6 for materials reducing to 5000 to 500 cp viscosity can be as high as 50 mW/sq.in. producing a gravity flow melt output of 0.7#/hr./sq.in.

Figure 2:
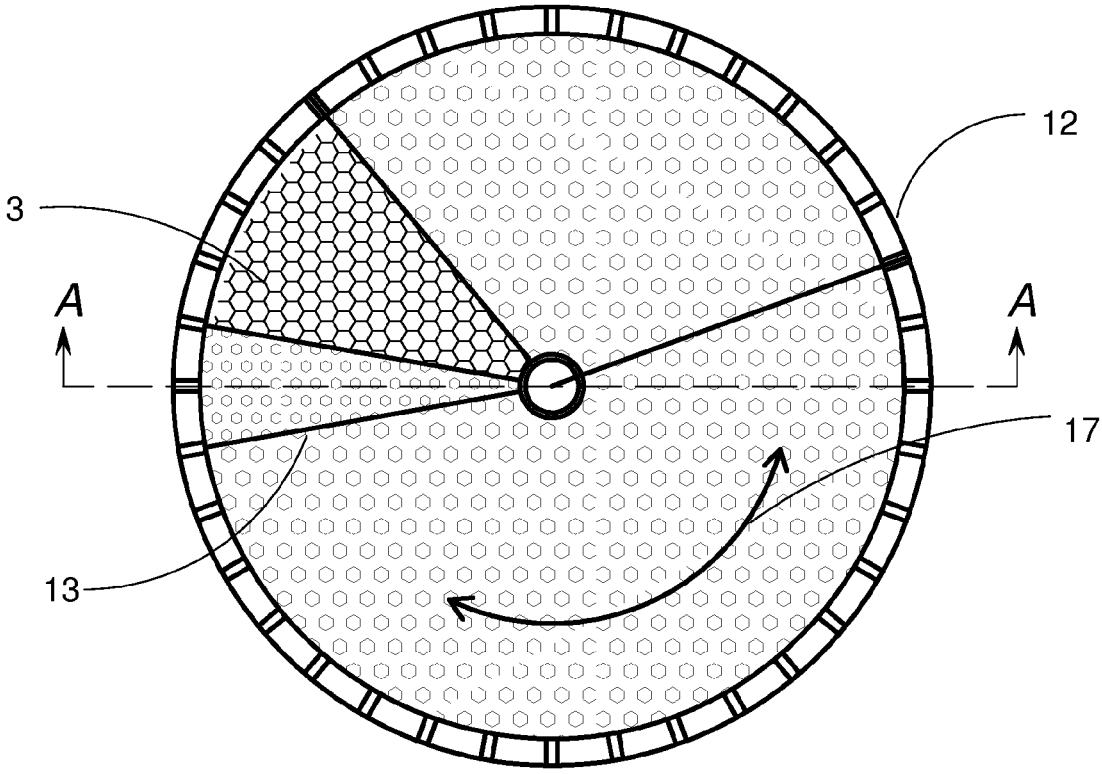
FIG. 2 is a top view of FIG. 3

A top view of an apparatus for melting and mixing is illustrated in FIG. 2. A round vessel 11 has movable partitions 12 at the entry end that separate multiple solid particulate thermoplastic polymers. The opposite end of this chamber shown in FIG. 3 has a gathering exit 13 for mixed hot liquid. Multiple material types are melted and combined in a particular proportion and exited the vessel at a specific temperature.

Particulate thermoplastic material 14 is fed to a chamber that is partitioned to its formulated proportion of the hot mix. Secondary particulate thermoplastic material 15 is fed to a minor chamber. When there is a major difference in the various particulate sizes, a flow-moderating pattern 16 of defined mesh is added to the bottom section of the stationary susceptor 3.

Inductor coil 1 creates an alternating magnetic field 2 in the form of a toroid that intercepts the stationary susceptor 3 and rotating susceptor 4 inducing an electrical current 17 shown in sectional FIG. 2. These currents are the source of the resistive losses that create the controlled heat for the process. The amount of induced power introduced to each susceptor can be controlled by their mass proportion and relative position to the inductor coil 1.

The placement of the inductor coil 1 in the annulus between susceptors 3 and 4 lowers the reluctance for the magnetic field 2 and thereby aids the efficiency of the power transfer. The resistance losses of the inductor coil 1 are additive to the liquefying thermoplastic materials 14 and 15. In this embodiment of the invention the inductor coil 1 is a two-sided printed circuit with the top and bottom sides being a coincident image of a nautilus form. These copper coils are joined at the center and exit at the same location at the edge. The substrate material is a PTFE/glass fiber material with strength at temperature characteristics that are compatible with constant exposure at the melt temperature. The entire circuit board is pattern perforated prior to forming the inductor coil circuit. The upper surface of the inductor coil is electrically insulated from the stationary susceptor by an open mesh PTFE fabric 18. The discs of this fabric, the stationary susceptor 3, and inductor coil 1 are supported at their periphery by an insert ring 19 at the bottom of the cylindrical chamber 20. These elements in turn support the load of pellets 14 and 15 above.

A drive shaft 21 extending through the vessel is attached to rotating susceptor 4. The rotating susceptor shaft 21 is made of PEEK to minimize thermal conduction and has a seal 26 placed to prevent air being drawn into the melt. The shaft coupling 23 is supported by a ceramic bearing 27. The mixed thermoplastic material exits through vents 28 in the steel coupling.

Thermocouple 10 is monitored by the high frequency power supply control to allow rotation of shaft 21 only when the melting material has reached the liquid state. This requires only a few seconds from a cold start and no delay when the material application process is off for periods shorter than that required for the in-process material to cool and solidify.

Figure 3:
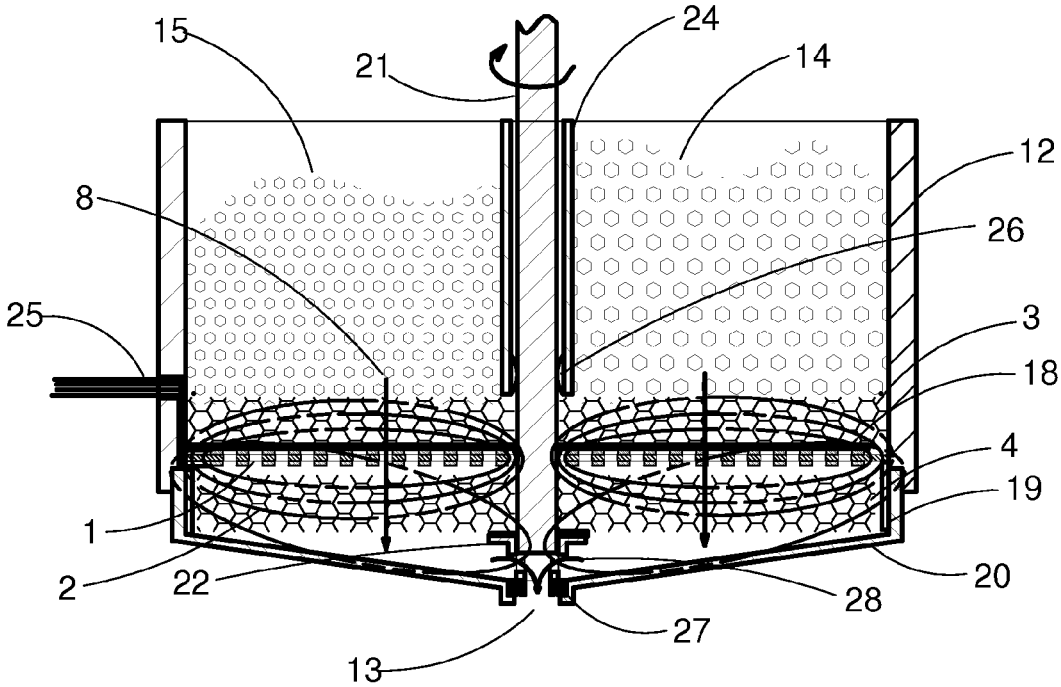
FIG. 3 is a sectional view of an apparatus for simultaneous melting and mixing

Susceptors 3 and 4 are exaggerated in thickness in FIG. 3 for illustration purposes. The thermoplastic polymer materials migrate through the stationary susceptor, inductor coil, and the rotating susceptor in the direction of arrow 8 in a few seconds. When in a power off state, the minor mass of the susceptor minimizes the latent heat in the system and only pellets in a single contacted layer on the stationary susceptor upper surface melt. The material of the lower portion of vessel 20 is made of steel and intercepts the magnetic field 2 in a minority to aid in the speed of start-up and retention of heat between on-off cycles. This downstream proportion of heat input is adjusted by the position of ring 23.

The upper portion of the vessel 12 and the tubular center stem 24 are made of fiberglass pipe to avoid heat conduction into the pellet chambers. The high frequency power entry 25 to the inductor coil 1 is made through the non-electrical conducting vessel wall 12 at the periphery of the coil. Depending in the size of the vessel and the desired output temperature and volume, the frequency of the power supply is adjusted from 30 Khz to 100 KHz. The system can be sized to any required output volume with temperatures controlled from 150° F. to 450° F.

Figure 4:
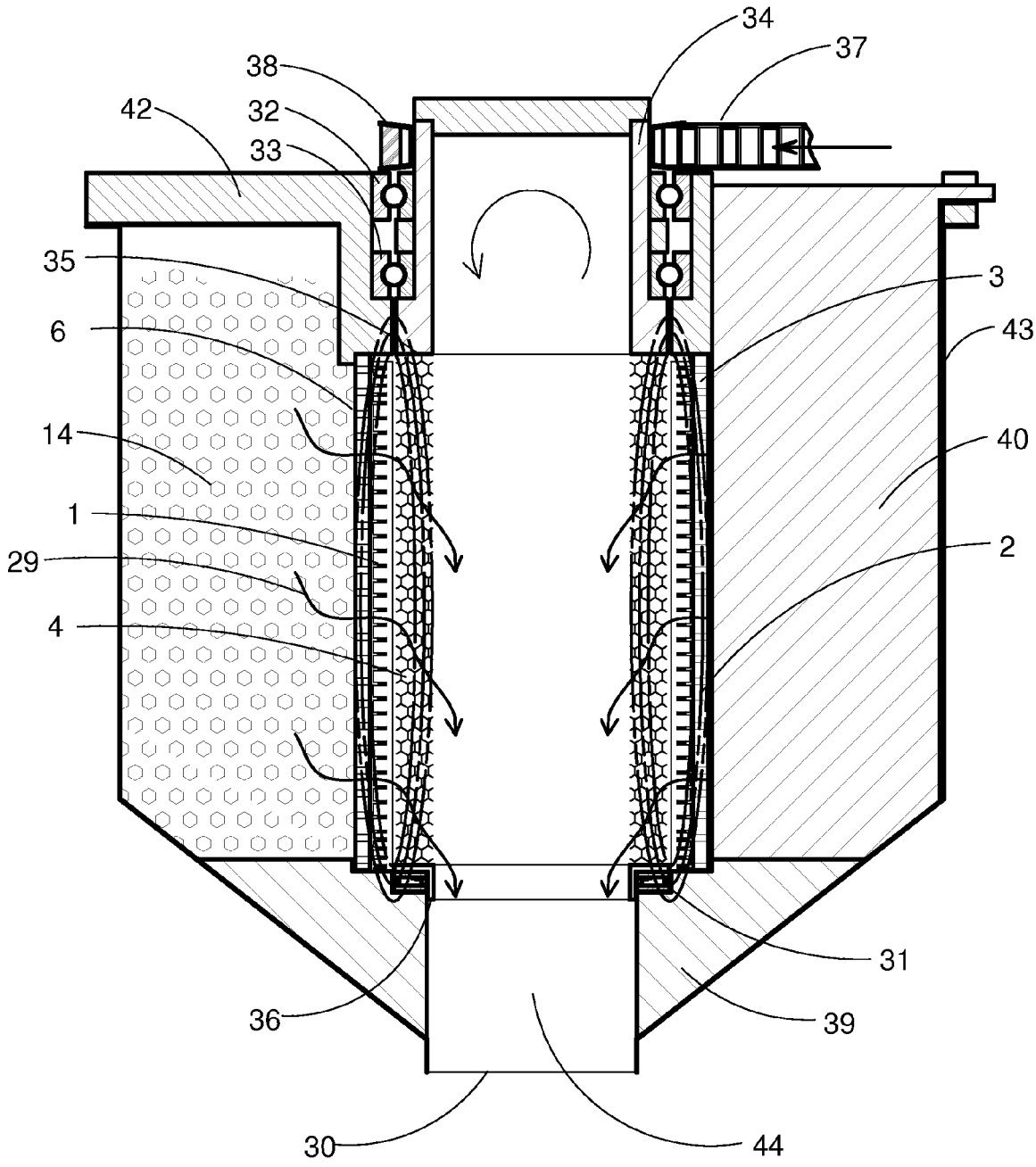
FIG. 4 is a sectional view of the apparatus utilizing vertical concentric susceptors

FIG. 4 is a cross section of a second embodiment of the invention that utilizes an interior vertical wall of a cylindrical container as the primary susceptor 3. Thermoplastic pellets 14 melt at primary susceptor surface 6 and migrate laterally as depicted by arrows 29 through inductor coil 1 and rotating susceptor 4 to exit as mixed material at exit 30.

Rotating susceptor 4 is positioned and supported at the bottom end by radial bearing 31. Top bearings 32 and 33 maintain upper axis alignment for nonmetallic tubular shaft 34 that is attached to the top surface 35 of rotating susceptor 4. The assembled rotating column of tubular shaft 34, bearings 32 & 33, rotating susceptor 4, and attached locating collar 36 is rotated by a variable speed motor via timing belt 37 and pulley 38. The rotating members of the assembly, thrust bearing 31, inductor coil 1, and primary susceptor 3 are positioned and supported in the container by nonmetallic base 39. Container partitions 40 are located in base 39 and at the top by slots 41 in a three spoke hub 42 that is attached to cylindrical steel container 43. Magnetic field 2 is shaped as a toroid that intercepts only susceptors 3 & 4 and thrust bearing 31.

The inner diameter of the rotating susceptor 4 and the central passage for melted material is chosen in his embodiment of the invention to accommodate the diameter of a gerotor pump placed in the central space 44 at the exit end to draw liquid material in through its upper face and exit pressurized material through its lower face. The motor shaft is driven from above.

An advantage of the vertical susceptor form is that it presents more susceptor surface and therefore greater output for the physical size of the apparatus. This embodiment of the invention looses the advantage of being able to vary the space between the susceptors and the inductor coil to proportion the heat imparted to each susceptor. This confines its application to a specific formulation, but applies itself well to a pressure pumped application.

Figure 5:
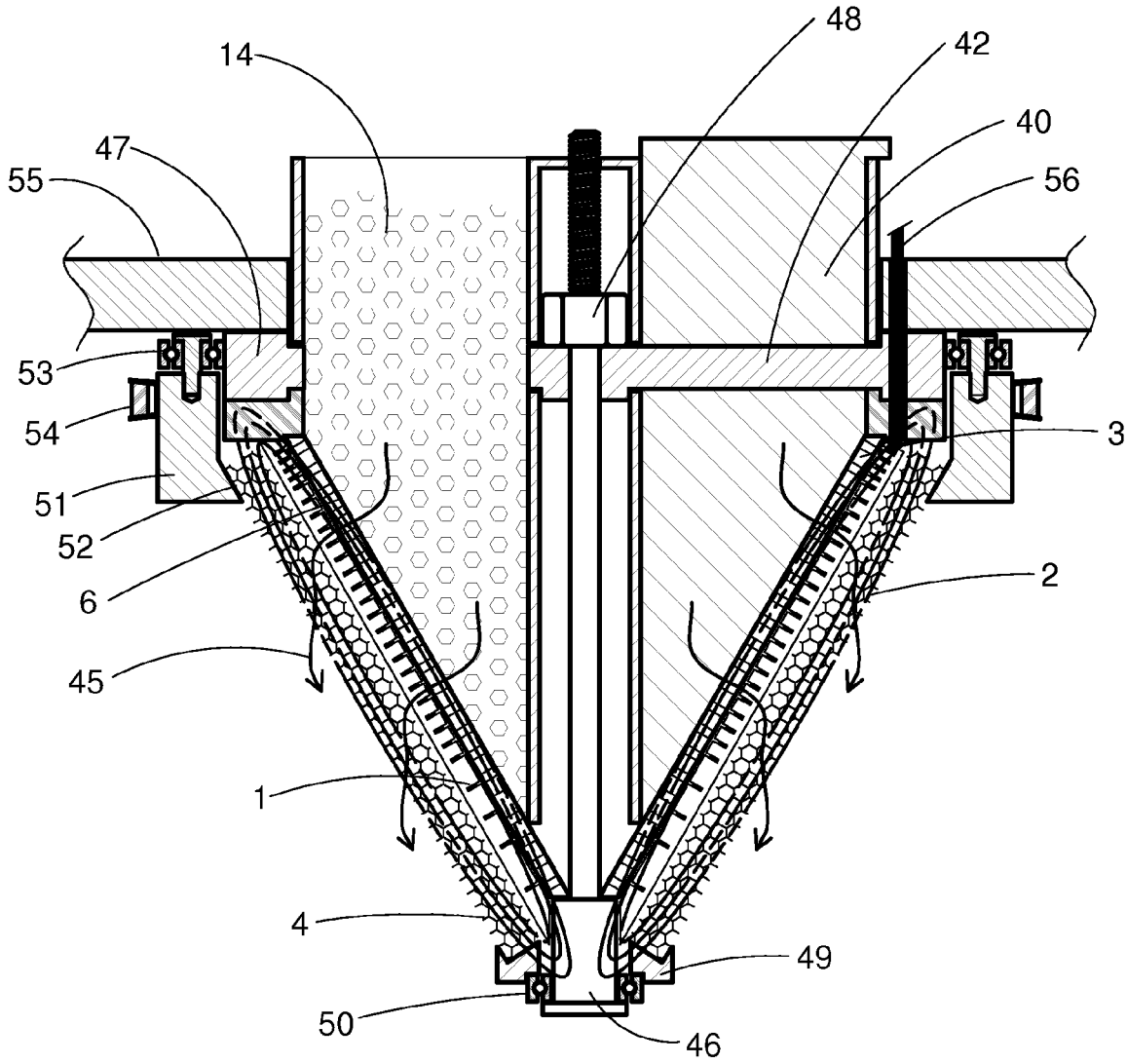
FIG. 5 is a sectional view of the apparatus utilizing conical concentric susceptors

FIG. 5 illustrates a third form of the apparatus of the invention that repositions the major elements illustrated in FIG. 4 as concentric truncated cones sectioned on their axis. Arrows 45 represent melted material flowing from the interior of the vessel to an exposed exterior where it clings to the face of rotating susceptor 4 and falls as a unitary stream from susceptor positioning stem 46.

Stem 46 holds stationary primary susceptor 3 and its thermal insulating ring 47 in an axis orientation with a three spoke hub 42 with draw nut 48. Stem 46 also holds rotating susceptor 4 on the axis with locator 49 that rides on the exterior race of bearing 50. Ring 51 is attached to rotating susceptor 4 at its peripheral surface 52 and is guided by cam follower bearings 53 as variable speed rotation is provided by timing belt through hub 54. The entire assembly is attached to deck 55 that supports the rotation drive motor and the high frequency power supply to energize inductor coil 1 through power entry 25.

The cone form of the apparatus drains of melted material completely upon shut down and therefore restarts generating a minimal amount of material below the target temperature. The space between the susceptors and the inductor coil can be positioned to proportion the heat imparted to each susceptor.

I claim:

1. An apparatus for melting and mixing multiple thermoplastic materials comprising:

a partitioned container having one surface constructed of pervious metal for receiving and containing solid particulate material;

a second concentric pervious metal surface to mix melted material, rotatable relative to the first pervious metal surface, a magnetic induction heating coil positioned between these two surfaces that are acting as susceptors of induced heat for transmission to thermoplastic materials, an electric motor to impart rotation to the second pervious metal surface, and a source of alternating current to power the induction heating coil.

2. An apparatus according to claim 1 whose pervious metal surfaces are concentric perforated metal cylinders, discs, or cones.

3. An apparatus according to claim 1 whose pervious metal surfaces are concentric metal foam cylinders, discs, or cones.

4. An apparatus according to claim 1 whose inductor coil is formed by a perforated printed circuit board printed on either one or both sides.

5. An apparatus according to claim 1 where the container's pervious metal surface has a perforated gravity flow moderator added to one or more of the partitioned sections.

6. An apparatus according to claim 1 with a material container that is both a reservoir of material and a heat transmitting pervious magnetic susceptor.

7. An apparatus according to claim 1 where the gravity flow of material through the susceptors is aided by the suction of a fluid pump.

8. An apparatus according to claim 1 where the reactive materials are purged from the susceptors and inductor coil by the higher viscosity material of the combination at a temperature reduced greater viscosity.

* * * * *